US006736601B2

(12) United States Patent
Nielsen et al.

(10) Patent No.: US 6,736,601 B2
(45) Date of Patent: May 18, 2004

(54) IMPELLER FOR AN AXIAL FLOW FAN AND A METHOD OF MOUNTING A BLADE ON A HUB FOR SUCH FAN

(75) Inventors: Steffen Richter Nielsen, Næstved (DK); Bent Bergmann Hansen, Næstved (DK)

(73) Assignee: Howden Power A/S, Naestved (DK)

( * ) Notice: Subject to any disclaimer, the term of this patent is extended or adjusted under 35 U.S.C. 154(b) by 0 days.

(21) Appl. No.: 10/257,753

(22) PCT Filed: Apr. 17, 2000

(86) PCT No.: PCT/DK00/00197

§ 371 (c)(1),
(2), (4) Date: Oct. 17, 2002

(87) PCT Pub. No.: WO01/79705

PCT Pub. Date: Oct. 25, 2001

(65) Prior Publication Data

US 2004/0009067 A1 Jan. 15, 2004

(51) Int. Cl.[7] ..... F04D 29/36
(52) U.S. Cl. ..... 416/206
(58) Field of Search ..... 416/206, 205, 416/204 R, 214 A, 214 R, 219 A, 87, 89

(56) References Cited

U.S. PATENT DOCUMENTS

| | | | | |
|---|---|---|---|---|
| 2,665,054 A | | 1/1954 | Fischer | |
| 3,073,395 A | | 1/1963 | Duncan | |
| 3,255,827 A | | 6/1966 | Nichols | |
| 3,545,884 A | | 12/1970 | Schroeter et al. | |
| 3,984,194 A | * | 10/1976 | Fermer et al. | 415/135 |
| 5,127,801 A | * | 7/1992 | Mortensen | 415/205 |
| 5,445,497 A | | 8/1995 | Seemar | |

FOREIGN PATENT DOCUMENTS

| | | |
|---|---|---|
| DE | 712870 | 10/1941 |
| DK | 125108 | 12/1972 |
| SE | 181 876 | 12/1962 |

* cited by examiner

*Primary Examiner*—Edward K. Look
*Assistant Examiner*—J. M. McAleenan
(74) *Attorney, Agent, or Firm*—Sughrue Mion, PLLC

(57) ABSTRACT

An impeller (1) for an axial flow fan comprises a hub (2) supporting the blades (3). The hub (2) has bores (5) in its peripheral surface, whereby each bore (5) has a first radially inner section (10) with larger diameter than a second radially outer section (6). Each blade (3) has a substantially circular foot section (4) allowing adjustment of the blade pitch. Mach blade foot section (4) is mounted in a corresponding bore (5) by means of two connecting plates (8, 9) which in the first bore section (10) are spaced apart and face each other along substantially the entire diameter of the bore (5).

10 Claims, 2 Drawing Sheets

Figure 1:
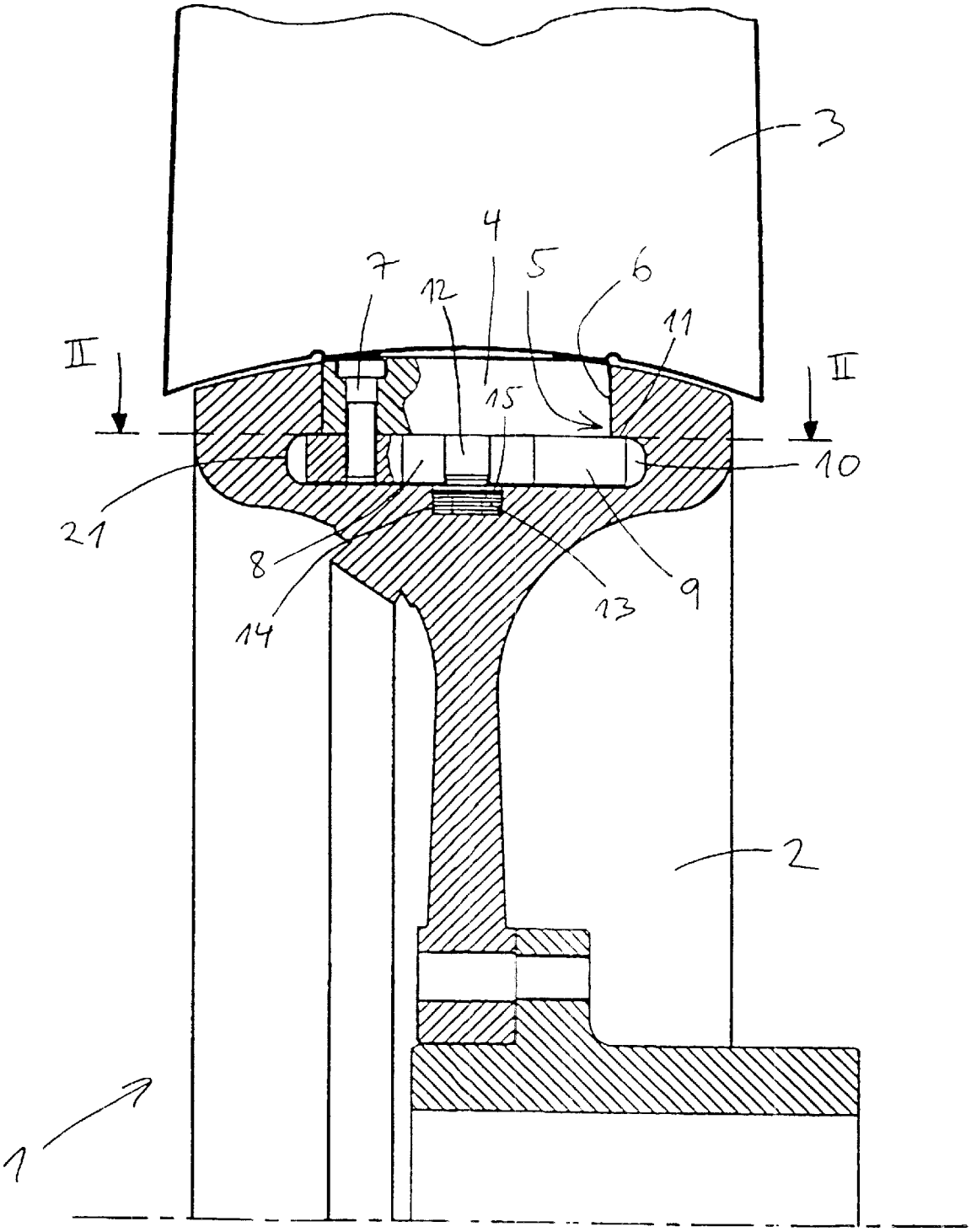

IMPELLER FOR AN AXIAL FLOW FAN AND A METHOD OF MOUNTING A BLADE ON A HUB FOR SUCH FAN

The present invention relates to an impeller for an axial flow fan comprising a hub supporting the blades, the hub having bores in its peripheral surface, whereby each bore has a first radially inner section with larger diameter than a second radially outer section, each blade having a substantially circular foot section allowing adjustment of the blade pitch, each blade foot section being mounted in a corresponding bore by means of connecting plates engaging with a shoulder between the two bore sections.

In conventional axial flow fans of this type the blade foot section is clamped against six connecting plates, each of which constitutes a segment of a circular disc, the segments being arranged in the bore in spaced relationship in order to permit mutual displacement by insertion and removal of the plates from the bore section. At the centre of the arrangement of the segments the borders of the segments jointly form a circular hole, in which a retaining ring is fitted in a groove at insertion of the segments in order to keep these in place while mounting the blade foot section and especially during subsequent rotation of the foot section in the bore for adjustment of the blade pitch. The connecting plates are pressed against the shoulder in the bore by means of a spring placed in the central hole. However, by the known fans, it is a disadvantage that the blade foot section in certain cases may have a tendency to lock in its corresponding bore in the hub, thereby impeding adjustment of the pitch.

The object of the invention is to provide an impeller of the type described in the introduction, whereby the above mentioned problem is remedied, and whereby at the same time a solid connection between the blade and the hub is obtained.

In view of this object, the impeller according to the invention is characterized in that each blade foot section is mounted by means of two connecting plates which in the first bore section are spaced apart and face each other along substantially the entire diameter of the bore.

By arranging two larger connecting plates in this way, instead of using six smaller in the conventional way, the connecting plates are far less inclined to tilt by rotation in the bore and thereby impede adjustment of the blade in relation to the hub. Furthermore, the larger plates provide sufficient space for the provision of more than one bolt in respect of each plate for clamping the blade foot section against the plate. This further reduces the tendency of the plates to tilt in the bore, thereby also facilitating the adjustment of the blade pitch. Moreover, the contact surface between the connecting plates and the shoulder in the bore may in this way be constituted by two relatively long continuous areas, as opposed to six discretely arranged small areas in the prior art impellers. The more uniform structure of the total contact area between the connecting plates and the shoulder provides less frictional force by rotation of the blade foot section. Furthermore, a much more uniform stress distribution may be obtained in the hub around the respective bores, as well as in the foot section of the blade, against which the connecting plates are clamped, this resulting in a considerably stronger connection between blade and hub.

In an advantageous embodiment very simple to manufacture the connecting plates have sections, the periphery of which extend substantially along a circle having a diameter larger than that of the second bore section in the hub, and the largest dimension of each plate is shorter than the diameter of said bore section. In this manner, a uniform, continuous contact surface is obtained between the connecting plate and the shoulder in the corresponding bore, thereby providing a further improved stress distribution, especially in the hub material surrounding the bore. In addition, the two connecting plates necessary for mounting one blade can be machined by turning one circular disc, cutting it through diametrically, thereby removing sufficient material for provision of the space necessary between the two plates in their mounted position, and eventually, if necessary, cutting off the extreme tips to allow the plates to enter through the second bore section.

In a further advantageous embodiment, a radial clearance is provided between the periphery of the connecting plates and the first bore section. In this manner, adjustment of the blade pitch may be further facilitated in that tilting of the connecting plates during rotation of the blade cannot cause engagement between the periphery of the connecting plates and the wall material of the first bore section.

A blade shaft projecting from the blade foot section may be clamped against an elastic member located in the bore under the connecting plates. By providing the elastic member under the connecting plates, the member does not take up any space between the plates, and no cutout or other reduction of the plate material, which would reduce its strength, is required.

The elastic member may have the form of one or more disc springs located in a hole in the bottom of the bore in the hub, which hole may have substantially the same diameter as the outer diameter of the springs. In this manner, the elastic member is kept in place when mounting the blade, possibly further by a retaining ring mounted in the hole.

The present invention also relates to a blade connecting means for mounting an impeller blade on a hub for an axial flow fan, the connecting means comprising connecting plates adapted to be clamped against a foot section of the blade and engage in a corresponding bore in the hub with a shoulder between a first radially inner bore section with larger diameter than a second radially outer bore section. According to the invention, the blade connecting means is characterized in that there is provided two connecting plates which are adapted to be mounted in the first bore section spaced apart and facing each other along substantially the entire diameter of the bore.

The invention further relates to a blade for an axial flow fan comprising the above described blade connecting means.

The invention also relates to a method of mounting a blade on a hub for an axial flow fan, whereby a blade foot section is clamped against connecting plates located in a corresponding bore in the peripheral surface of the hub, and the connecting plates are caused to engage with a shoulder between a first radially inner bore section with larger diameter than a second radially outer bore section. According to the invention, the method is characterized by clamping the blade foot section against two connecting plates which are spaced apart and face each other along substantially the entire diameter of the bore.

The connecting plates may be positioned in such a manner that the periphery of sections of the plates extend substantially along a circle having a diameter larger than that of the second bore section in the hub, and each of the plates utilized may have a maximum dimension that is shorter than the diameter of said bore section.

The connecting plates may be positioned in such a manner that a radial clearance is provided between the periphery of the connecting plates and the first bore section.

Figure 2:
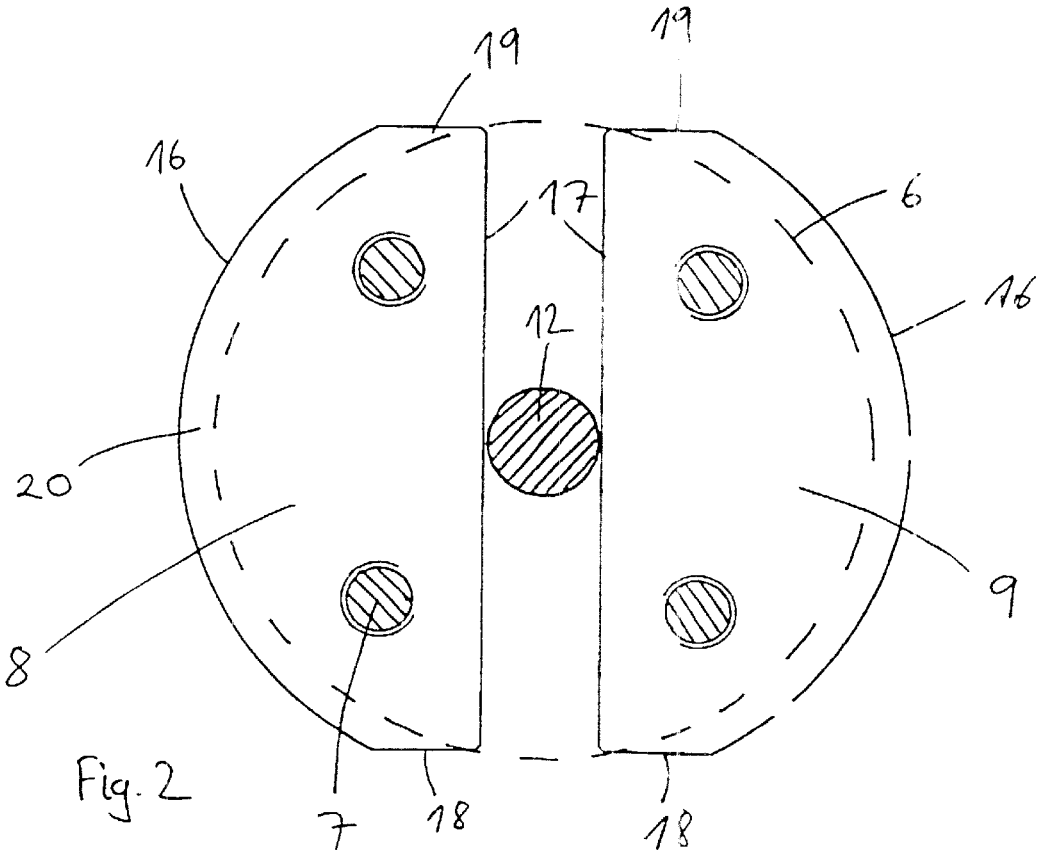
Figure 3:
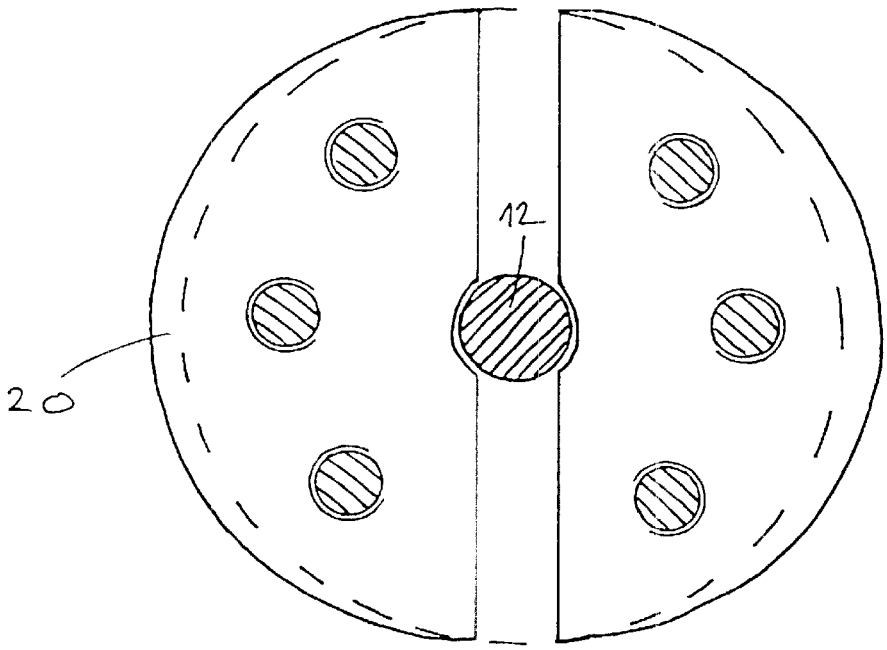

The invention will now be explained in more detail below by means of examples of embodiments with reference to the schematic drawing, in which FIG. 1 shows an axial sectional view of an embodiment of an impeller for an axial flow fan according to the invention, FIG. 2 is a partially sectional view of the impeller of FIG. 1 along the line II—II showing the connecting plates, and FIG. 3 is a view corresponding to that of FIG. 2 of another embodiment of the connecting plates.

FIG. 1 illustrates an impeller 1 comprising a hub 2 and a number of blades 3 projecting radially from the hub. Each blade 3 comprises a circular foot section 4 which fits in a radially outer second bore section 6 of a bore in the peripheral surface of the hub 2.

In the mounted state shown in the figure, the blade foot section 4 is by means of bolts 7, such as wing screws, clamped against two connecting plates 8, 9 located in an radially inner first bore section of the bore 5. The inner bore section has a larger diameter than that of the outer bore section 6, so that an inward shoulder 11 is formed between the two sections 6, 10. The connecting plates 8, 9 project radially from the circular foot section 4 and a peripheral part of the outward surface of the plates abuts the shoulder 11. The wall 21 of the inner bore section is rounded in order to reduce stress in the hub material. Furthermore, the connecting plates 8, 9 are radially spaced apart from the wall 21 in order to avoid engagement between the plates and the wall as a result of possibly tilting plates at adjustment of the blade pitch.

A blade shaft 12 projects coaxially from the blade foot section 4 and extends between the two connecting plates 8, 9. The shaft 12 is fabricated integrally with the blade foot section, but it may also be fixed in the foot section, such as by means of threads. By clamping the blade foot section 4 against the connecting plates 8, 9, the lower end of the shaft 12 is also clamped against a spring means, such as a stack of disc springs 13. The disc springs 13 are accommodated in a hole 14 provided in the bottom of the bore and are retained in the hole during mounting of the blade by means of a retaining ring fitted in a groove located in the hole 14 above the disc springs 13.

As a result of the spring pressure on the lower end of the shaft 12, a contact pressure is applied between the connecting plates 8, 9 and the shoulder 11 between the bore sections 6, 10, thereby providing a frictional force keeping the blade foot section 4 fixed in the bore 5. However, this frictional force can be overcome by manual rotation of the blade foot section 4 in the outer bore section 6 in order to adjust the blade pitch. In operation of the impeller, the frictional force will increase considerably as a result of the centrifugal force and the blades will not be able to rotate in the bores 5.

FIG. 2 shows a partial section through the impeller 1 along the line II—II in FIG. 1, whereby the hub 2 is only indicated by a dashed line which designates the radially outer second bore section 6. The connecting plates 8, 9 are symmetrical with respect to a diameter of the bore and each plate is delimited by a segment 16 of a circle, an opposed straight line 17, and at each end of the line 17, a line 18, 19 at right angles to the line 17 connecting the respective end of the circle segment 16 with the associated end of the straight line 17. The circle segments 16 extend along a circle having a diameter larger than that of the second bore section 6 in the hub 2, whereby is provided a contact area between the surface of the connecting plates 8, 9 and the shoulder 11 in the bore 5, this area having constant width along the circle segments, thereby providing a relatively uniform stress distribution in the hub material around the bore 5. The space between the two lines 17 of the connecting plates 8, 9 enables the insertion and removal of the plates through the smaller bore section 6 by approaching the plates to each other. The plates are shortened at the lines 18, 19 in order to keep the overall length smaller than the diameter of the bore section 6, also in order to enable insertion or removal of the plates.

After insertion of the connecting plates 8, 9 through the smaller bore section 6, they are moved apart so that their circular rims engage under the shoulder 11 in the bore 5. Subsequently, the blade foot section 4 is inserted in the outer bore section 6 and is connected with the plates 8, 9 by means of the bolts 7. Each plate 8, 9 is connected with the foot section by means of two bolts, whereby the possibility of tilting of the plate during adjustment is reduced, thereby facilitating the adjustment. When the bolts 7 are tightened, the blade foot section 4 is clamped against the plates 8, 9 and the blade shaft 12 is pressed against the stack of disc springs 13, this causing the plates 8, 9 to be driven outwards in the bore section 10, whereby their upper surface rim areas are pressed against the shoulder 11. Consequently the blade foot section 4 is secured safely in the hub 2.

FIG. 3 shows another embodiment of the connecting plates 8, 9, whereby the plates have been machined from one circular disc which has been cut straight through along a diameter, substantially without removing any material. As the disc used has a diameter slightly smaller than that of the smaller bore section 6 in the hub 2, the resulting connecting plates may pass through said bore section. Furthermore, there has been cut out some material at the centre of said diameter to make room for the blade shaft 12 in the mounted position of the plates 8, 9. The plates are inserted in the bore 5 in the same way as for the above described embodiment. Additionally, in this embodiment each plate is provided with three bolts.

The connecting plates may have other shapes and forms than those shown in the drawings without departing from the basic principle of the invention, in particular the shown embodiments may be combined. By way of example, the connecting plates need not be symmetrical and they need not have a segment of circular periphery.

What is claimed is:

1. An impeller (1) for an axial flow fan comprising a hub (2) supporting the blades (3), the hub (2) having bores (5) in its peripheral surface, whereby each bore (5) has a first radially inner section (10) with larger diameter than a second radially outer section (6), each blade (3) having a substantially circular foot section (4) allowing adjustment of the blade pitch, each blade foot section (4) being mounted in a corresponding bore (5) by means of connecting plates engaging with a shoulder (11) between the two bore sections (6, 10), characterized in that each blade foot section (4) is mounted by means of two connecting plates (8, 9) which in the first bore 1S section (10) are spaced apart and face each other along substantially the entire diameter of the bore (5).

2. An impeller according to claim 1, wherein the connecting plates (8, 9) have sections, the periphery of which extend substantially along a circle having a diameter larger than that of the second bore section (6) in the hub (2), and wherein the largest dimension of each plate (8, 9) is shorter than the diameter of said bore section (6).

3. An impeller according to claim 1, wherein a blade shaft (12) projecting from the blade foot section (4) is clamped against an elastic member (13) located in the bore under the connecting plates (8, 9).

4. An impeller according to any one of the preceding claims, wherein a blade shaft (12) projecting from the blade foot section (4) is clamped against an elastic member (13) located in the bore under the connecting plates (8, 9).

5. An impeller according to claim 4, wherein the elastic member has the form of one or more disc springs (13) located in a hole (14) in the bottom of the bore (5) in the hub (2), which hole (14) has substantially the same diameter as the outer diameter of the springs (13).

6. A blade connecting means for mounting an impeller blade (3) on a hub (2) for an axial flow fan, the connecting means comprising connecting plates adapted to be clamped against a foot section (4) of the blade (3) and engage in a corresponding bore (5) in the hub (2) with a shoulder (11) between a first radially inner bore section (10) with larger diameter than a second radially outer bore section (6), characterized in that there is provided two connecting plates (8, 9) which are adapted to be mounted in the first bore section (10) spaced apart and facing each other along substantially the entire diameter of the bore (5).

7. A blade (3) for an axial flow fan comprising blade connecting means according to claim 6.

8. A method according to claim 7, whereby the connecting plates (8, 9) are positioned in such a manner that the periphery of sections (16) of the plates extend substantially along a circle having a diameter larger than that of the second bore section (6) in the hub (2), and whereby each of the plates (8, 9) utilized has a maximun dimension that is shorter than the diameter of said bore section (6).

9. A method according to claim 8, whereby the connecting plates (8, 9) are positioned in such a manner that the periphery of sections (16) of the plates extend substantially along a circle having a diameter larger than that of the second bore section (6) in the hub (2), and whereby each of the plates (8, 9) utilized has a maximum dimension that is shorter than the diameter of said bore section (6).

10. A method according to claim 9, whereby the connecting plates (8, 9) are positioned in such a manner that a radial clearance is provided between the periphery of the connecting plates and the first bore section (10).

* * * * *